United States Patent [19]

Berens et al.

[11] 4,263,159

[45] Apr. 21, 1981

[54] AUTOMATIC TRANSMISSION FLUID COMPRISING ESTERS DERIVED FROM A PARTICULAR MONOCARBOXYLIC ACID COMPOSITION

[75] Inventors: George Berens, Bardonia; Milton L. Honig, Bronx, both of N.Y.

[73] Assignee: Stauffer Chemical Company, Westport, Conn.

[21] Appl. No.: 58,969

[22] Filed: Jul. 20, 1979

Related U.S. Application Data

[63] Continuation of Ser. No. 889,687, Mar. 24, 1978, abandoned.

[51] Int. Cl.[3] ..... C10M 3/20

[52] U.S. Cl. ..... 252/79; 252/56 S

[58] Field of Search ..... 252/79, 56 S

[56] References Cited

U.S. PATENT DOCUMENTS

| | | | |
|---|---|---|---|
| 2,798,083 | 7/1957 | Bell et al. | 252/56 S X |
| 3,282,971 | 11/1966 | Metro et al. | 260/410.6 |
| 3,360,465 | 12/1967 | Warman | 252/56 S |
| 3,609,085 | 9/1971 | Langenfeld | 252/79 |
| 3,694,382 | 9/1972 | Kleiman et al. | 252/56 S |
| 4,053,491 | 10/1977 | Koch et al. | 252/56 S X |
| 4,144,183 | 3/1979 | Koch et al. | 252/56 S |

OTHER PUBLICATIONS

Barnes et al., "Synthetic Ester Lubricants", Lubrication Engineering, Aug. 1957, pp. 454–458.

*Primary Examiner*—Harris A. Pitlick
*Attorney, Agent, or Firm*—Roger S. Benjamin

[57] ABSTRACT

An automatic transmission fluid consisting of a base ester fluid, and optionally other additives. The base ester fluid is the reaction product of:

(a) an aliphatic polyol containing from 2 to 6 primary hydroxyl groups, with (b) a monocarboxylic acid composition comprising:
  (i) a low molecular weight acid composition, and
  (ii) an alpha-branched acid composition.

The low molecular weight acid composition is comprised of at least one saturated monocarboxylic acid of from 3 to 8 carbon atoms.

The alpha-branched acid composition is comprised of at least one saturated monocarboxylic acid of from 11 to 13 carbon atoms. The alpha-branched acid composition contains at least about 40% by weight of alpha-branched monocarboxylic acid.

The molar ratio of acid composition (i) to acid composition (ii) is sufficient to produce a base ester fluid having a pour point no greater than −40° F.

10 Claims, No Drawings

AUTOMATIC TRANSMISSION FLUID COMPRISING ESTERS DERIVED FROM A PARTICULAR MONOCARBOXYLIC ACID COMPOSITION

This is a continuation of application Ser. No. 889,687, Mar. 24, 1978, and now abandoned.

BACKGROUND OF THE INVENTION

This invention relates to synthetic functional fluids and more particularly to synthetic functional fluids containing an ester formed from the reaction of a polyol with certain monocarboxylic acid compositions.

It has been discovered that functional fluids of this type are particularly adapted for use in automatic transmissions.

The fluid in an automatic transmission serves several functions. It serves as a power-transmission fluid in the torque converter, an hydraulic fluid in the control and servo systems, a lubricant for the bearing and gears, and a friction-controlling medium for the bands and clutches. In addition, it serves as a heat-transfer medium to carry the heat generated in the transmission to the wall of the torque converter, which is cooled by air circulation, or to a separate water-cooled heat exchanger.

Operating temperatures in many newer transmissions have increased sharply. In many cases, transmission drain intervals have been extended or eliminated entirely. These factors have led to the development of new and improved transmission fluids.

Petroleum lubricants, which have heretofore been used as automatic transmission fluids, are generally incapable of meeting both high and low temperature performance requirements. Petroleum oils can be modified, for example, by addition of kerosene to improve low temperature properties, however, the fluids then become too volatile for continued high speed, high temperature operation. Conversely, petroleum oils can be modified to provide good high temperature properties, but such compositions generally become too viscous at low temperatures and thus do not function properly in cold weather.

Known synthetic esters while being capable of imparting some improved properties over petroleum based fluids, have generally been found unsuitable for use as automatic transmission fluids. One reason for the lack of acceptance of synthetic esters as automatic transmission fluids is due to their incompatibility with the seals used in automatic transmissions. Particularly preferred elastomers used in automatic transmissions are the copolymers of butadiene-acrylonitrile (Buna-N) and polyacrylates. The incompatibility of synthetic esters with such seals results in insufficient or excessive swelling of the seal.

Insufficient or excessive swell causes the seals to lose their ability to retain and confine the transmission fluid. Leakage occurs which can cause high fluid consumption.

Controlled seal swell is, therefore, an important characteristic of an acceptable automatic transmission fluid. It is essential that the fluid be capable of imparting a controlled swelling of the transmission seals to prevent leakage of the fluids.

By the use of the term "seal swell" it is meant the amount, in percent, that the volume of a seal expands or contracts upon contact with, and exposure to, the transmission fluid under transmission operating conditions.

Typically, seal swell is measured by ASTM standard D 471-72.

DEXRON II is a General Motors' automatic transmission fluid. It is highly desirable that an automatic transmission fluid meet all the specifications for a DEXRON II fluid in order to be commercially acceptable (Specification GM 6137-M). This entire GM Specification is incorporated herein by reference. The DEXRON II specifications require a Buna-N seal swell of from +1.% to +5.%, a polyacrylate seal swell of 0 to +10% and a silicone seal swell of 0 to +5%. The hardness change limits are 0 to −5, 0 to +5 and 0 to −10, respectively.

It is also highly desirable that an automatic transmission fluid meet all of the Ford M-2C33G specifications. This entire Ford Specification is incorporated herein by reference.

An automatic transmission fluid must also have an acceptable viscosity range to enable it to be liquid at temperatures as low as minus 40° F. and still retain film strength to adequately lubricate at operating temperatures that can approach 350° F. The viscosity characteristics of an automatic transmission fluid must be such that the fluid can be used over a wide temperature range, that is, adequate viscosity at high temperature, comparatively low viscosity at low temperatures and a low rate of change of viscosity with temperature.

Typically, viscosities are measured by ASTM standard D445 at 210° F., 100° F., 0° F. and −20° F. A satisfactory automatic transmission fluid should have a viscosity within the DEXRON II specifications:

| |
|---|
| Viscosity (centistokes, cS) at 210° F.: |
| 5.5 minimum |
| Brookfield Viscosity (centispoise, cP) |
| at −10° F.: 4,000 maximum |
| at −40° F.: 50,000 maximum. |

It is also highly desirable that an automatic transmission fluid have a viscosity within the Ford M-2C33G specifications:

| |
|---|
| Viscosity (centistokes, cS) at 210° F. |
| 6.35 minimum |
| Brookfield Viscosity (centipoise, cP) |
| at 0° F.: 1,400 maximum |
| at −40°F.: 40,000 maximum. |

The resistance of a fluid to viscosity change with a change in temperature is known as the viscosity index. In general, the greater the viscosity index the more desirable the fluid because of the greater resistance to thickening at low temperatures and to thinning out at high temperatures. A number of additives can be used to improve the viscosity index of a base ester fluid. Under high shear and under high temperatures and oxidation conditions, viscosity index improvers tend to break down and lose their ability to thicken the fluid. This causes the fluid to revert to the viscosity index of the base ester fluid. When the viscosity index decreases to an unsatisfactory level, the fluid must be replaced. Thus in order to insure that replacement of the transmission fluid will not occur too frequently, it is desirable that the transmission fluid have a satisfactory viscosity index without the need for a viscosity index improver, or at the very least, with a minimum amount of viscosity index improver, i.e. no greater than about 10%, and preferably no greater than about 3.%.

It is therefore desirable to have an automatic transmission fluid which has a viscosity index of at least about 125, without a viscosity index improver.

Typically, viscosity index is measured by ASTM Standard D 2270.

Coupled with an acceptable viscosity and viscosity index, a satisfactory automatic transmission fluid should have an acceptable pour point. The term "pour point" means the lowest test temperature at which the fluid will flow. Typically, pour point is measured by ASTM Standard D-97. A satisfactory automatic transmission fluid should have a pour point no higher than about −40° F.

Additionally, a satisfactory automatic transmission fluid must have suitable oxidation stability at least as good as a DEXRON II fluid or the Ford M-2C33G specifications. Oxidation stability can be measured by Federal Test Method Standard 791B, Method No. 5307, at various temperatures.

It is generally recognized in the art that a base fluid alone may not be able to meet all the foregoing standards. To meet these standards, the base fluid must be fortified with one or more additives to improve its characteristics. Thus, an automatic transmission fluid generally has contained therein, in addition to the base fluid, certain additives to optimize certain characteristics of the fluid. Thus, the base fluid used in automatic transmission fluids must also have "additive compatibility" to benefit from the incorporation of these additives. Many base fluids, including certain polyol esters, do not exhibit such additive compatibility. The term "additive compatibility" means the ability of the base fluid to dissolve additives without hazing, flocculating or settling out.

A non-limiting list of the more common type additives are:

(a) Oxidation Inhibitors;
(b) Rust Inhibitors;
(c) Copper Corrosion Inhibitors;
(d) Antiwear Agents;
(e) Detergents and Dispersants;
(f) Viscosity-Index Improvers;
(g) Foam Inhibitors; and
(h) Low Viscosity Diluents.

Several types of additives are generally added to a base fluid to form an automatic transmission fluid. A particular additive composition may serve a plurality of functions in the fluid.

The present invention has for an object a functional fluid containing a base ester fluid either alone or in combination with additives, which is capable of meeting the standards for a satisfactory automatic transmission fluid.

It is still another object of this invention to provide a base ester fluid for use in the automatic transmission fluid of this invention.

SUMMARY OF THE INVENTION

According to the present invention there is provided a functional fluid which comprises a base ester fluid which is the reaction product of:

(a) an aliphatic polyol containing from 2 to 6 primary hydroxyl groups; with
(b) a monocarboxylic acid composition comprising;
(i) a low molecular weight acid composition containing at least one saturated monocarboxylic acid of from 3 to 8 carbon atoms, and
(ii) an alpha-branched acid composition containing at least one saturated monocarboxylic acid of from 11 to 13 carbon atoms of which at least about 40% by weight is alpha-branched monocarboxylic acid;

wherein the molar ratio of acid composition (i) to acid composition (ii) is sufficient to produce a functional fluid having a pour point no greater than −40° F.

DETAILED DESCRIPTION OF THE INVENTION

For general guidance, it has been noted that as the quantity, i.e. weight percent, of alpha-branched monocarboxylic acid in the alpha-branched acid composition increases the pour point and viscosity index of the base ester fluid and the functional fluid decreases. To achieve the desired pour point and viscosity index in the base ester fluid and functional fluid requires balancing the quantities of alpha-branched monocarboxylic acid straight chain monocarboxylic acids and $C_{11}$, $C_{12}$, and $C_{13}$ monocarboxylic acids.

Additionally, the general guidance, it has been noted that as the molar ratio of acid composition (i) to acid composition (ii) increases the pour point decreases, and the high temperature viscosities decrease. In effect, increased quantities of acid composition (i) improves the low temperature properties of the base ester fluid and functional fluid.

It is particularly preferred that the molar ratio of acid composition (i) to acid composition (ii) be from about 0.05:1 to about 0.5:1. It is particularly preferred that the ratio be about 0.1:1 to about 0.3:1.

Preferably the alpha-branched acid composition used to produce the base ester fluid of this invention consists of at least about 50%, by weight, of alpha-branched monocarboxylic acids.

When the molar ratio of acid composition (i) to acid composition (ii) is adjusted to produce a functional fluid having a pour point no greater than −40° F., the functional fluid either alone or containing certaining additives, will have all of the characteristics of a satisfactory automatic transmission fluid.

It is highly preferred that normal, i.e. stright chain, acids be used in the low molecular weight acid compositions, although branched acids can be utilized. It is particularly preferred that the acid be n-valeric.

The invention envisions the use of an alpha-branched acid composition consisting essentially of pure $C_{11}$, $C_{12}$ or $C_{13}$ monocarboxylic acids, although for economic reasons mixtures of acids are preferred. The alpha-branched acid composition may additionally contain, to a limited extent, monocarboxylic acids of a greater or lesser number of carbon atoms.

A preferred alpha-branched acid composition contains from about 25% to about 40% of each of the $C_{11}$, $C_{12}$ and $C_{13}$ monocarboxylic acids.

By the use of the term "percent alpha-branching", it is meant the percent, by weight, of the monocarboxylic acid in an acid composition of $C_{11}$, $C_{12}$ and/or $C_{13}$ acid which is alpha-branched monocarboxylic acid.

"Alpha branching" of a chain of a monocarboxylic acid is branching which occurs at the carbon atom which is in the alpha position to the carboxyl group and has a hydrogen atom attached thereto. In other words, the carboxylic group is on the 2, 3, 4 etc. positions on the aliphatic chain. For example (where R is a normal alkyl substituent):

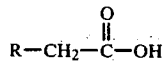
1-Acid (not alpha-branched)

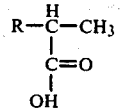
2-Acid (alpha-branched)

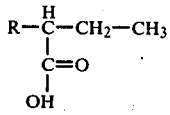
3-Acid (alpha-branched)

The use of the term "pour point" means the pour point of the functional fluid as determined by ASTM Standard D-97.

The preparation of the low molecular weight acid compositions and the alpha-branched acid compositions useful in the practice of this invention are well known in the art.

Carboxylic acids branched in the alpha-position to the carboxyl group and mixtures thereof can be obtained by oxidation of branched chain alcohols derived from petroleum.

The compositions used in this invention can also be produced by the reaction of ethylenically unsaturated compounds with carbon monoxide and water in the presence of certain catalysts and/or promoters. Such methods are exemplified by the following references:

(a) U.S. Pat. No. 3,579,551 to Craddock et al;
(b) U.S. Pat. No. 3,579,552 to Craddock et al;
(c) U.S. Pat. No. 3,816,488 to Craddock et al;
(d) U.S. Pat. No. 3,816,489 to Craddock et al;
(e) U.S. Pat. No. 3,816,490 to Forster et al;
(f) U.S. Pat. No. 3,818,060 to Forster et al;
(g) U.S. Pat. No. 3,821,265 to Forster et al;
(h) U.S. Pat. No. 4,000,170 to Forster et al;

The acid compositions can also be produced by the alkaline fusion reaction of primary alcohols, exemplified by U.S. Pat. No. 3,957,838 to Nishino et al.

The entire disclosures of all of the aforementioned references are incorporated herein by reference.

Preferably, for economic reasons, a mixture of $C_{11}$, $C_{12}$ and $C_{13}$ carboxylic acids are utilized as the alpha-branched acid compositions rather than pure $C_{11}$, $C_{12}$ or $C_{13}$ carboxylic acids. The mixture can be obtained, for example, as a direct product with minimal purification, from the reaction that produces the carboxylic acids.

The polyols useful in the practice of this invention should contain from 2 to 6 primary hydroxyl groups, i.e. diol, triols, tetrols, pentols and hexols, and mixtures thereof and includes the ether condensation product of 2 or more polyols. It is particularly preferred that the polyol contain from 2 to 4 primary hydroxyl groups.

The following is a non-limiting list of polyols which may be utilized to produce the base ester fluid of this invention:

2,2-dialkyl propane diols;
1,5-hexane diol;
ether glycols;
tetraethylene glycol;
2-methyl, 2-ethyl, 1,3-propanediol;
ethylene glycol;
trimethylene glycol;
tetramethylene glycol;
pentamethylene glycol;
glycerol;
1,3-butanediol;
1,4-butanediol;
neopentyl glycol;
2-butyl-2-ethyl-1,3 propanediol;
2,2,4-trimethyl-1,3 pentanediol;
trimethylol propane;
trimethylolethane;
pentaerythritol;
di-trimethylolpropane;
pentaerythritol-trimethylol propane dimers; and
di-pentaerythritol.

In accordance with this invention, the polyols can be used singly or as mixtures containing at least two polyols. It is however preferred to use a polyol which is substantially pure polyol, i.e. a single type polyol.

Highly preferred polyols for use in producing the base ester fluid of this invention are neopentyl polyols represented by the structural formula:

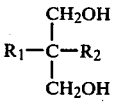

wherein $R_1$ and $R_2$ are each independently selected from the group consisting of $CH_3$, $C_2H_5$ and $CH_2OH$. Examples of such neopentyl polyols include, pentaerythritol, trimethylolpropane, trimethylolethane and neopentyl glycol. It is particularly preferred that the base ester fluid be a trimethylolpropane ester.

The base ester fluids of this invention can be prepared by known procedures used for the preparation of esters. The monocarboxylic acid composition, consisting of a mixture of (i) the low molecular weight acid compositions and (ii) the alpha-branched acid compositon and polyol can be reacted by direct thermal fusion, with or without a catalyst. Known catalysts such as acids, Lewis-type acids, metallic oxides, and the like can be utilized. The water of reaction is removed from the reaction mixture. Generally, the monocarboxylic acid composition is reacted with the polyol in a proportion which provides a substantially completely esterified polyol.

One particularly preferred method of producing the base ester fluids of this invention is described in U.S. Pat. No. 3,056,818 to Werber, the entire disclosure of which is incorporated herein by reference.

Preferably, the base ester fluids are prepared by reacting a polyol with the monocarboxylic acid composition, in liquid phase, in the presence of a catalyst. The reaction proceeds very slowly at room temperature, however at elevated temperatures, preferably under reflux, the reaction rate is quite rapid, so that about 99% of the acid is converted to ester within a few hours. To facilitate the completion of the reaction, the water of esterification is removed as it forms. This can be accomplished by carrying out the reaction in a liquid medium which forms an azeotrope having a boiling point that is lower than that of either component of the reaction. It is to be understood, however, that if the reactants and the ester which results boil at temperatures well above 212° F. at atmospheric pressure, the reaction temperature can be sufficiently high to require no azeotrope forming liquid reaction medium.

The reaction can be carried out under reduced or superatmospheric pressures so long as the reactants remain liquid.

Preferred catalysts are the organo-titanium or organo-zirconium compounds having at least one organic group which can be an alkoxyl group, an acyl group, an alkyl, a dialkyl amino group or an aromatic group or an aromatic hydrocarbon group attached to the titanium or zirconium atom through an oxygen atom. These type catalysts and their use as esterification catalysts are described more fully in the Werber patent.

A particularly preferred catalyst of this type is tetra-n-butyl titanate.

Additive components may be advantageously incorporated in the base ester fluid of this invention to form the functional fluid used as an automatic transmission fluid. Generally, as indicated previously, the typical additives include:

(a) Oxidation Inhibitors;
(b) Rust Inhibitors;
(c) Copper Corrosion Inhibitors;
(d) Antiwear Agents;
(e) Detergents and Dispersants;
(f) Viscosity Index Improvers;
(g) Foam Inhibitors; and
(h) Low Viscosity Diluents.

OXIDATION INHIBITORS

This invention envisions the use of any type oxidation inhibitor which is compatible with the base ester fluid of this invention. It has been found that many of the commonly used oxidation inhibitors are compatible with the base ester fluid.

Oxidation inhibitors delay the formation of varnish, sludge, and acids during the extended operating periods and minimize corrosion problems with lead, iron, aluminum, magnesium, babbitt, zinc, and copper bearing alloys which are corroded by the organic acids formed by oxidation of the automatic transmission fluid.

Generally organic compounds containing sulfur, nitrogen, phosphorus, or alkylphenols may be employed to inhibit the oxidation process.

A preferred type oxidation inhibitor used in this invention comprises an aromatic amine having the formula:

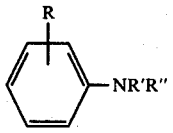

in which R is hydrogen or an alkyl radical having from 1 to 8 carbon atoms, R' is hydrogen or an alkyl radical having from 1 to 6 carbon atoms and R" is hydrogen or a phenyl, naphthyl, aminophenyl or an alkyl-substituted phenyl radical in which the alkyl radical has from 1 to 8 carbon atoms. Examples of these antioxidants include p-p'dioctyl diphenylamine. N-phenyl-1-naphthylamine, N-phenyl-p-phenylene diamine, N-N'-diphenyl-p-phenylene diamine, N,N'-bis(octylphenyl)-p-phenylene diamine, p-hydroxy-diphenylamine, N-phenyl-N-isopropyl-p-phenylene diamine, and N, N'-dioctyl-p-phenylene diamine.

Other oxidation inhibitors which may be used are di-t-butyl-p cresol, 2-naphthol and zinc, barium and calcium thiophosphates.

Additional oxidation inhibitors are described in U.S. Pat. No. 3,634,248 and U.S. Pat. No. 3,247,111 the entire disclosures of which are incorporated herein by reference.

The oxidation inhibitors may be employed in effective amounts ranging from about 0.01% to about 10% by weight of the automatic transmission fluid with the preferred amount being from about 0.2% to about 2%.

A particularly preferred oxidation inhibitor for use in the automatic transmission fluid of this invention is N-phenyl-1-naphthylamine, preferably present in the automatic transmission fluid in an amount of about 0.5%.

RUST INHIBITORS

This invention additionally envisions the use of any type rust inhibitor which is compatible with the base ester fluid of this invention. It has been found that many of the commonly used rust inhibitors are compatible with the base ester fluid.

Rust inhibitors are surface-active materials which are adsorbed as a film on iron and steel surfaces to protect them from attack by moisture. Rust inhibitors are polar organic acids such as those of the alkylsuccinic type and organic amines and the more strongly adherent organic phosphates, polyhydric alcohols and sodium and calcium sulfonates.

The rust inhibitors may be employed in effective amounts ranging from about 0.01% to about 10%, by weight of the automatic transmission fluid, with the preferred amount being from about 0.2% to about 2%.

Particularly preferred rust inhibitor for use in the automatic transmission fluid of this invention are commercial rust inhibitor compositions containing calcium sulfonate sold under the trademarks LUBRIZOL 78 by the Lubrizol Corp., and OLOA 2938 by Chevron Chemical Co. The rust inhibitor composition is preferably present in the automatic transmission fluid in an amount of about 0.8%.

COPPER CORROSION INHIBITOR

This invention additionally envisions the use of any type corrosion inhibitor which is compatible with the automatic transmission fluid of this invention. It has been found that many of the commonly used corrosion inhibitors are compatible with the base ester fluid.

Corrosion inhibitors such as dialkyl thiadiazoles, acid, alizarin, benzotriazole, purpurxanthrene, anthrarufin and chrysazin can be advantageously employed in the automatic transmission fluid of this invention.

The corrosion inhibitors may be employed in effective amounts ranging from about 0.0005% to 0.5% by weight of the automatic transmission fluid, with the preferred amount being from about 0.01% to about 0.1%.

A particularly preferred corrosion inhibitor for use in the automatic transmission fluid of this invention is benzotriazole, preferably present in the automatic transmission fluid in an amount of about 0.02%.

ANTIWEAR AGENTS

This invention further envisions the use of any type of antiwear agent which is compatible with the base ester fluid of this invention. It has been found that many of the commonly used antiwear agents are compatible with the base ester fluid.

Antiwear agents produce a surface film by either a chemical or physical adsorption mechanism to minimize friction and wear under boundary lubrication conditions.

Generally these antiwear agents can be classified as (1) compounds containing oxygen (fatty acids esters, ketone); (2) compounds containing sulfur, or combinations of oxygen and sulfur; (3) organic chlorine compounds (chlorinated waxes); (4) organic sulfur compounds (sulfurized fats, sulfurized olefins); (5) compounds containing both chlorine and sulfur; (6) organic phosphorus compounds (tricresyl phosphate, thiophosphates, phosphites); and (7) organic lead compound.

The overall effectiveness of antiwear agents is often improved by using combinations of several types in a given lubricating fluid.

The antiwear agents may be employed in effective amounts ranging from about 0.01% to about 1.0% by weight, of the automatic transmission fluid, with the preferred amount being from about 0.15% to about 0.6%.

A particularly preferred antiwear agent for use in the automatic transmission fluid of this invention is a commercial antiwear composition containing zinc dialkyldithiophosphate sold under the trademark OLOA 267 by Chevron Chemical Co. The antiwear composition is preferably present in the automatic transmission fluid in an amount of about 0.4%.

DETERGENTS AND DISPERSANTS

This invention further envisions the use of any type detergent and dispersant which is compatible with the base ester fluid of this invention. It has been found that many of the commonly used detergents and dispersants are compatible with the base ester fluid.

Oil detergents prevent or remove deposits of oil-insoluble sludge, varnish, carbon and lead compounds from transmission parts. They maintain insoluble materials as a suspension in the fluid to minimize deposits and maintain cleanliness. Generally, barium and calcium sulfonates and phenoxides may be used for transmission fluids. Ashless dispersants, such as methacrylates polymers are often employed in combination with these organometallics to minimize low-temperature sludging.

The detergents and dispersants may be employed in effective amounts ranging from about 0.5% to about 5% by weight, of the automatic transmission fluid with the preferred amount being from about 0.5% to about 1%.

A particularly preferred commercial composition which contains a detergent and dispersant for use in the automatic transmission fluid of this invention is the detergent-dispersant additive package sold under the trademark OLOA 373C by Chevron Chemical Co. which contains a bis-succinimide of polyethylene amine.

This commercial composition is preferably present in the automatic transmission fluid in an amount of about 1.0%.

VISCOSITY INDEX IMPROVERS

This invention additionally envisions the use of any type of viscosity index improver which is compatible with the base ester fluid of this invention. It has been found that many of the commonly used viscosity index improvers are compatible with base ester fluid.

Viscosity index improvers function by thickening a light oil at transmission operating temperatures, while exerting a minimal effect on viscosity at lower temperatures.

Generally, oils of higher viscosity index and also lower pour point can be obtained by adding a linear polymer, to the automatic transmission fluid. The most commonly used viscosity index improvers are polyisobutylenes, polymethacrylates and poly(alkylstyrenes) which have a molecular weight in the range of about 5000 to about 20,000 (about 350 to about 1400 carbon atoms).

The viscosity index improvers are usually employed in transmission fluids in effective amounts of up to about 10%, by weight of the lubricating fluid.

Due to the unexpected characteristics of the base ester fluid of this invention only up to 3.0% of improver is required for formulation of a satisfactory automatic transmission fluid. A particularly preferred viscosity index improver is a composition containing a dispersant type of polymethacrylate as TEXACO TC 9849 by Texaco, Inc.

This composition is preferably present in the automatic transmission fluid in an amount of about 1.0%.

FOAM INHIBITORS

This invention additionally envisions the use of foam inhibitors which are compatible with the base ester fluid of this invention. It has been found that many of the commonly used foam inhibitors are compatible with the base ester fluid.

Generally, methyl silicone polymers ranging from about 300 cSt to about 100 cSt viscosity at 100° F. or a hydrocarbon or kerosene concentrate of a dialkyl silicone are effective for defoaming the automatic transmission fluid of this invention. Effective antifoam agents include dimethyl silicone, diethyl silicone, dibutyl silicone and the like.

The foam inhibitors required may be employed in effective amounts of up to about 0.01 percent by weight of the automatic transmission fluid.

A particularly preferred foam inhibitor for use in the automatic transmission fluid of this invention is SWS-101, by SWS Silicones Div., Stauffer Chemical Co., Adrian, Mich. SWS 101 contains a dimethyl silicone.

This foam inhibitor is preferably present in the automatic transmission fluid in an amount of about 25 ppm.

LOW VISCOSITY DILUENTS

This invention additionally envisions the use of low viscosity diluents which are compatible with the base ester fluid of this invention. It has been found that many of the commonly used low viscosity diluents are compatible with the base ester fluid.

By the use of the term "low viscosity diluents" it is meant a base oil composition which contains polyalpha olefin fluids, dicarboxylic acid diesters, polyol esters, mineral oils and the like which are added to the base ester fluid of this invention to lower the viscosity of the lubricating oil and impart improved low temperature properties to the lubrication oil, i.e. viscosity and pour point.

The low viscosity diluent, if required, may be employed in effective amounts of up to about 15%, by weight, of the automatic transmission fluid. It has been found however, that the low temperature properties of the preferred base ester fluid are such that a low viscosity diluent is not required.

An important feature of the automatic transmission fluid of this invention is the relative proportions of each component therein. It has been discovered that a selective balance of the components should be maintained in order to achieve optimum properties in the formulation. Table I illustrates the broader and preferred ranges of concentrations of additive components which can be in the automatic transmission fluid formulation in order to realize the optimum desired results.

TABLE I

| ADDITIVE COMPONENT | RANGE PERCENT BY WEIGHT | PREFERRED RANGE PERCENT BY WEIGHT |
|---|---|---|
| Oxidation Inhibitor | .01-10. | .2-2. |
| Rust Inhibitor | .01-10. | .2-2. |
| Copper Corrosion Inhibitor | .0005-.5 | .01-.1 |
| Antiwear Agents | .01-1. | .15-.6 |
| Detergents and Dispersants | .5-5. | .5-1. |
| Viscosity Index Improvers | up to 10. | up to 3. |
| Foam Inhibitors | up to .01 | up to .01 |
| Low Viscosity Diluents | up to 15. | — |

The automatic transmission fluid of this invention can be prepared by intimately mixing the additive components with the base ester fluid at preferably a temperature ranging from about 40° C. to about 225° C., and most preferably, at about 65° C. No particular order of addition need be followed.

For a better understanding of the present invention, specific embodiments of the invention are presented below. These examples and illustrations are not to be construed in any way as limiting the scope of the invention.

EXAMPLE 1

Alpha-Branched Acid Composition

A preferred alpha-branched acid composition for use in this invention has the following homolog and isomer weight percent distribution:

| | 1—Acid | 2—Acid | 3—Acid | 4+Acids | Total |
|---|---|---|---|---|---|
| $C_{10}$ | 1.4 | 0.7 | — | — | 2.1 |
| $C_{11}$ | 10.9 | 12.5 | 2.9 | 5.5 | 31.8 |
| $C_{12}$ | 14.3 | 12.5 | 3.2 | 8.0 | 38.0 |
| $C_{13}$ | 8.3 | 10.4 | 2.4 | 6.6 | 27.7 |
| Total | 34.9 | 36.1 | 8.5 | 20.1 | 99.6 |
| Other Acid | | | | | .4% |

The foregoing acid composition is about 66% alpha branched, i.e. 66% by weight, of the total $C_{11}$, $C_{12}$ and $C_{13}$ acids are branched.

The following is a typical chemical analysis:

| | |
|---|---|
| Color, APHA | 50. |
| Iodine No.[1] | 1.7 |
| Acid No.[2] | 278. |
| Peroxide No.[3] | 1.0 |
| Unsaponifiable[4] | .2 |
| Titer °C.[5] | 3.7 |

[1]AOAC Method 28-021
[2]ASTM Method D-1980
[3]AOAC Method 28-073
[4]AOAC Method 28-063
[5]AOAC Method 28-013

EXAMPLE 2

Alpha-Branched Acid Composition

A particularly preferred alpha-branched acid composition for use in this invention has the following homolog and isomer weight percent distribution:

| | 1—Acid | 2—Acid | 3—Acid | 4 + Higher Acids | Total |
|---|---|---|---|---|---|
| $C_{11}$ | 11.1 | 12.4 | 3.0 | 5.6 | 32.1 |
| $C_{12}$ | 12.0 | 11.3 | 2.9 | 7.4 | 33.6 |
| $C_{13}$ | 10.9 | 11.2 | 2.9 | 9.3 | 34.3 |
| Total | 34.0% | 34.9% | 8.8% | 22.3% | 100.0% |

The foregoing acid is 66.0% alpha-branched.

EXAMPLES 3 and 4

Trimethylol Propane Base Ester Fluid

The base ester fluid of this invention was produced according to the following reaction:

$$\text{Trimethylol Propane} + 2.5\ (\text{alpha-branched acid composition}) + .5\ (\text{low molecular weight acid composition}) \xrightarrow[245^\circ\text{ C. VM and P Naphtha}^{(1)}]{} 3\ H_2O + \text{Esters}$$

[1]Varnish Makers and Paint Naphtha

Two batches were made using the following raw materials:

| Raw Materials | Mol. Wt | Moles | Grams |
|---|---|---|---|
| 1. Trimethylol Propane (100%) | 134. | 1.0 | 134. |
| 2. Alpha-branched acid Composition of Ex. 2 | 201. | 2.62[2] | 528. |
| 3. N-valeric acid | 102. | .525[2] | 53.6 |
| 4. Tetra-n-butyl titanate catalyst | | | 1.0 |
| 5. VM and P Naphtha | | | 100. |

[2]5. mole % excess

A two-liter 3-neck round bottom flask was fitted with:

(a) a motor driven glass stirrer with blade and bushing seal of TEFLON;
(b) a Dean-Starch water trap of 100 ml. capacity;
(c) a Friedrich condenser;
(d) a pot thermometer 0°-360° C.;
(e) a heating mantle; and
(f) a pot temperature controller.

The pure trimethylol propane was added by means of a powder funnel to the flask. The alpha-branched acid composition and n-valeric acid was also added to the flask.

Tetra-n-butyl titanate (TNBT) was added as the catalyst. The TNBT catalyst decomposes upon exposure to moisture in the air, therefore the reactor should be dry and purged with nitrogen prior to the TNBT addition. VM & P Naphtha was used as the azetropic water removal agent. The charge was then stirred and heated at reflux until no more water formed for eight hours. A total of 53 ml of water was collected (theoretical water formation is 54 ml). During the heating period the temperature of the charge increased from 180° to 250° C.

The charge was then heated to 270° C. (atmos. pressure) in order to remove solvent and excess acids. No distillation column was used.

The charge was vacuum stripped at a pot temperature of 140°-270° C./~1.0 mm Hg. 43 ml. of distillate (light ends), b. pt. 110°-170° C./~1.0 mm. was collected to give a crude ester bottoms product having an acid number of ~1.0.

After cooling to 70° C., the crude ester was transferred into a 2 liter 3-neck flask to which was added 1 wt. % of anhydrous calcium oxide and 2.5 wt.% of water.

The charge was stirred and heated for two hours at 100° C. (reflux).

The bulk of the water was removed by distillation and the charge heated up to a 130° C. temperature at atmospheric pressure.

The charge was filtered hot (~100° C.) thru a Buchner funnel containing Watman Filter paper No. 4 to which was added a small layer of Celite filter aid.

The ester was vacuum stripped to dryness at 120° C./2.0 mm Hg. While still hot, ~20 gms. of basic aluminum oxide was added and the charge stirred for ten minutes and filtered as above to give 483 gms. of a clear filtrate having the following properties:

BASE ESTER FLUID

| PROPERTIES | EXAMPLE 3 | EXAMPLE 4 |
|---|---|---|
| Acid No | 0.043 | 0.020 |
| $n_D^{25}$ | 1.4545 | 1.4540 |
| $d_{25}$ | 0.91 | 0.91 |
| APHA Color | 300 | 300 |
| IR | clean scan | clean scan |
| % Yield | 75 | 84 |

The products displayed the following average properties:

| | |
|---|---|
| Viscosity Centistokes | |
| 210° F. | 5.98 |
| 100° F. | 32.63 |
| 0° F. | 907 |
| Pour Point, °F. | −35 |
| Viscosity Index | 137 |
| Buna N Swell (%) :+0.93 | |
| Evaporation (300° F./22 Hr.) | 0.69% |

EXAMPLE 5

An automatic transmission fluid was formulated as follows:

| FORMULATION | PERCENT, BY WEIGHT |
|---|---|
| Base Ester Fluid of Example 4 | 96.28 |
| N-phenyl-1-naphthylamine | .5 |
| Benzotriazole | .02 |
| Calcium sulfonate compositions (LUBRIZOL 78+ OLOA 2938) | .8 |
| Zinc dialkyldithiophosphate (OLOA 267) | .4 |
| Bis-succinimide of polyethylene amine (OLOA 373 C) | 1.0 |
| A dispersant type of polymethacrylate (TEXACO TC 9849) | 1.0 |
| Dimethyl silicone (SWS-101) | 25 ppm |

The foregoing automatic transmission fluid had the following properties compared to the DEXRON II Specifications (Reference: Specification GM-6137M) and the Ford M-2C33G Specification.

| Typical Properties | Example 5 Automatic Transmission Fluid | GM DEXRON II Specification | FORD M-2C33G Specification |
|---|---|---|---|
| Viscosity (cS) | | | |
| at 210° F. | 6.95 | 5.5 min. | 6.35 min. |
| at 100° F. | 29.7 | — | — |
| at 0° F. | 1190 | — | — |
| at −20° F. | 3680 | — | — |
| Brookfield Viscosity (cP) | | | |
| at 0° F. | 1100 | — | 1400 max. |
| at −10° F. | 2030 | 4000 max. | — |
| at −40° F. | 36,950 | 50,000 max. | 40,000 max. |
| Viscosity Index | 148 | — | — |
| Pour Point (°F.) | −45° | — | — |
| Flash Point (°F.) | 515° | 320° min | 350° min. |
| Fire Point (°F.) | 600° | 350° min. | — |
| Total Acid No. mgKOH/g | 0.47 | — | — |
| Added Metals, wt. % | 0.10 | 0.5 max. | — |
| Phosphorus, wt. % | 0.034 | 0.065 | — |
| Sulfur, wt. % | 0.076 | 1.0 max. | — |
| Miscibility with reference mineral oil automatic transmission fluid | Good | Good | Good |
| Ford Four Ball | .37 | — | .45 |
| Copper Strip (a) 3 Hrs. at 300° F., ASTM D 130 | (a) No Blackening or Flaking | (a) No Blacken- or Flaking | — |
| (b) Ford BJZ1-1 | (b) 1 B Rating | | (b) 1 B max |
| Non-Corrosion and Non-Rusting Properties (D-665) | No Rust | No Rust | No Rust |
| G. M. Rust (Panel Test) ASTM D 1748 | No Rust or Corrosion | No Rust or Corrosion | — |

EFFECTS ON SEALS

I. GM DEXRON II SPECIFICATIONS

| | Example 5 Automatic Transmission Fluid | GM DEXRON II SPECIFICATION |
|---|---|---|
| Total Immersion | | |
| Buna N % Swell | 3.3% | 1 to 5% |
| Hardness Change | −3 | 0 to −5 |
| Dip Cycle | | |
| Polyacrylate | | |
| % Swell | 10.8% | 0 to 10% |
| Hardness Change | +1 | 0 to +5 |
| Dip Cycle | | |
| Silicone | | |
| % Swell | 3.7% | 0 to 5% |
| Hardness Change | −1 | 0 to −10 |

EFFECTS ON SEALS

II. FORD M-2C33G SPECIFICATION

| | Example 5 Automatic Transmission Fluid | FORD M-2C33G Specification |
|---|---|---|
| Buna N % Swell | 4.4% | +3% to +8% |
| Hardness Change | +6 | −10 to +10 |
| Bend Test | No Cracking | No Cracking |
| Polyacrylate | | |
| % Swell | 11.7% | +3 to +11% |
| Hardness Change | −10 | −10 to +10 |
| Bend Test | No Cracking | No Cracking |
| Silicone-Smear Test | Pass | Pass |

COMPARISON OF AUTOMATIC TRANSMISSION FLUID OF EXAMPLE 5 WITH COMMERCIAL MINERAL OIL TRANSMISSION FLUID IN AN OXIDATION STABILITY TEST (Federal Test Method Standard 7916, Method 5307)

| | Viscosity Increase | Acid No. Increase mgKOH/g |
|---|---|---|
| Automatic Transmission Fluid of Example 5 | 0.8% | 1.46 |
| DEXRON II Automatic Transmission Fluid | 3400% | 12.0 |
| Ford Type F Automatic Transmission Fluid | Too viscous for measurement (>5000%) | 7.4 |

Conditions: 347° F., 168 hrs., 5L/Hr. Air.

What is claimed is:

1. An automatic transmission fluid consisting essentially of a base ester fluid which is the substantially completely esterified reaction product of:
   (a) trimethylolpropane; with
   (b) a monocarboxylic acid composition consisting essentially of:
      (i) at least one saturated monocarboyxlic acid of from 3 to 8 carbon atoms, and
      (ii) a mixture of saturated monocarboxylic acids of from 11 to 13 carbon atoms containing from about 25% to about 40% each of $C_{11}$, $C_{12}$, and $C_{13}$ monocarboxylic acids of which at least about 40% by weight are alpha branched monocarboxylic acid represented by the formula:

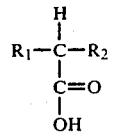

wherein $R_1$, and $R_2$ are alkyl substituents of from 1 to 10 carbon atom and the sum of the carbon atoms in $R_1$ and $R_2$ are from 9 to 11, with the proviso that some of the alpha branching be at the 2 or 3 carbon position;

wherein the molar ratio of (i) to (ii) is from about 0.1:1 to about 0.3:1 and is sufficient to produce an automatic transmission fluid base ester having a pour point no greater than about −40° F.

2. The functional fluid of claim 1, wherein the alpha-branched acid composition contains at least about 50%, by weight, alpha-branched monocarboxylic acids.

3. The functional fluid of claim 1, wherein the polyol and the monocarboxylic acid composition are reacted in the presence of a catalytically effective amount of tetra-n-butyl titanate.

4. The functional fluid of claim 1, further comprising an effective amount of oxidation inhibitor.

5. The functional fluid of claim 1, further comprising an effective amount of a rust inhibitor.

6. The functional fluid of claim 1, further comprising an effective amount of a copper corrosion inhibitor.

7. The functional fluid of claim 1, further comprising an effective amount of an antiwear agent.

8. The functional fluid of claim 1, further comprising an effective amount of a detergent and dispersant.

9. The functional fluid of claim 1, further comprising an effective amount of a viscosity index improver.

10. A method of operating an automatic transmission comprising applying to the moving parts of said transmission an effective quantity of an automatic transmission fluid comprised of the functional fluid of claim 1.

* * * * *